US008613264B2

(12) United States Patent
Gehrke et al.

(10) Patent No.: US 8,613,264 B2
(45) Date of Patent: Dec. 24, 2013

(54) GAS EXCHANGE VALVE FOR INTERNAL COMBUSTION ENGINES

(75) Inventors: Sebastian Gehrke, Braunschweig (DE); Christian Weiskirch, Braunschweig (DE); Wolfgang Bauer, Nürnberg (DE); Peter Eilts, Braunschweig (DE); Reinhard Lämmermann, Stein (DE)

(73) Assignee: MAN Nutzfahrzeuge AG, Munich (DE)

( * ) Notice: Subject to any disclaimer, the term of this patent is extended or adjusted under 35 U.S.C. 154(b) by 500 days.

(21) Appl. No.: 12/608,577

(22) Filed: Oct. 29, 2009

(65) Prior Publication Data

US 2010/0108003 A1 May 6, 2010

(30) Foreign Application Priority Data

Oct. 30, 2008 (DE) ..... 10 2008 054 014

(51) Int. Cl.
*F01L 9/02* (2006.01)

(52) U.S. Cl.
USPC ..... 123/90.12

(58) Field of Classification Search
USPC ..... 123/90.12, 90.13; 251/129.01
See application file for complete search history.

(56) References Cited

U.S. PATENT DOCUMENTS

| | | | | |
|---|---|---|---|---|
| 763,154 | A | 6/1904 | Holzwarth | |
| 1,746,227 | A | 2/1930 | Almen | |
| 1,760,853 | A | 5/1930 | Wood | |
| 5,058,538 | A | 10/1991 | Erickson et al. | |
| 5,231,959 | A | 8/1993 | Smietana | |
| 5,275,136 | A | 1/1994 | Schechter et al. | |
| 5,367,990 | A | 11/1994 | Schechter | |
| 5,560,753 | A | 10/1996 | Schnabel et al. | |
| 6,382,147 | B1 * | 5/2002 | Plohberger | 123/90.12 |
| 6,536,388 | B2 * | 3/2003 | Lou | 123/90.12 |
| 6,899,068 | B2 * | 5/2005 | Nan et al. | 123/90.12 |
| 6,988,471 | B2 * | 1/2006 | Chang | 123/90.12 |
| 7,007,642 | B2 * | 3/2006 | Diehl et al. | 123/90.12 |
| 7,255,074 | B2 * | 8/2007 | Han et al. | 123/90.11 |
| 7,766,302 | B2 * | 8/2010 | Lou | 251/63.6 |
| 2007/0193639 | A1 | 8/2007 | Ling et al. | |

FOREIGN PATENT DOCUMENTS

| | | |
|---|---|---|
| DE | 198 37 837 | 1/2000 |
| DE | 10201167 A | 5/2003 |
| DE | 10220275 A | 11/2003 |
| DE | 10 2004 018 359 | 11/2004 |
| EP | 0652355 A1 | 5/1995 |
| GB | 121 048 | 12/1918 |

(Continued)

*Primary Examiner* — Thomas Denion
*Assistant Examiner* — Daniel Bernstein
(74) *Attorney, Agent, or Firm* — Cozen O'Connor

(57) ABSTRACT

A gas exchange valve arrangement, especially for an internal combustion engine, with a valve head, which is mounted on a valve body. The valve body can be moved in a straight line in either of two opposite directions by an actuating element, which can be moved in either of the two directions of movement such that, as a result of a movement of the actuating element in at least one direction, the valve body is caused to move in the same direction. The actuating element comprises a piston, which can be moved relative to a space by a fluid medium. The space comprises a feed opening for the fluid medium, and the gas exchange valve arrangement includes a throttle device, which at least temporarily throttles the movement of the actuating element in at least one direction of its movement.

14 Claims, 2 Drawing Sheets

(56) References Cited

FOREIGN PATENT DOCUMENTS

| | | | |
|---|---|---|---|
| GB | 152 863 | | 10/1920 |
| GB | 12 523 | | 7/1921 |
| GB | 221 699 | | 9/1924 |
| WO | WO2004/038187 | A1 | 5/2004 |
| WO | WO 2004/094792 | | 11/2004 |

* cited by examiner

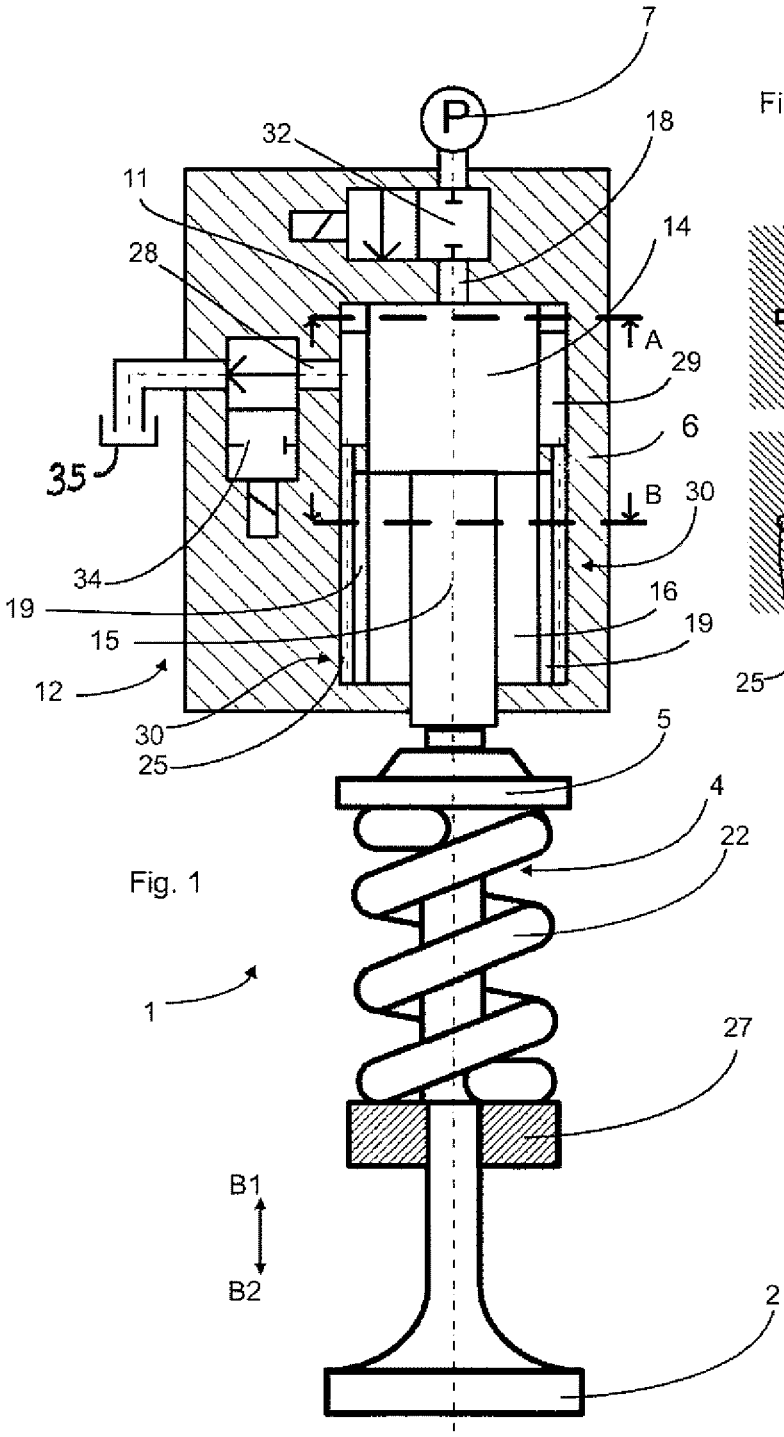
Fig. 1
Fig. 2a
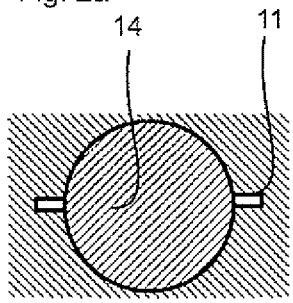
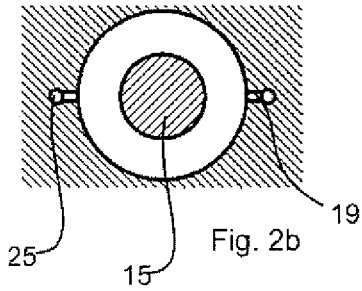
Fig. 2b

GAS EXCHANGE VALVE FOR INTERNAL COMBUSTION ENGINES

BACKGROUND OF THE INVENTION

1. Field of the Invention

The present invention relates to a gas exchange valve arrangement for an internal combustion engine.

2. Description of the Related Art

Gas exchange valves are known from the prior art. The prior art discloses many different principles for actuating gas exchange valves that control the operation of internal combustion engines. DE 198 37 837 C1 describes a device for actuating a gas exchange valve. In this device, an electromagnetic actuator is provided, that comprises an opening magnet and a closing magnet, between which an armature is able to move back and forth in an axial direction.

DE 10 2004 018 359 A1 describes a hydraulic actuating drive for gas exchange valves of an internal combustion engine. Here a stem of a gas exchange valve can be shifted between a first and a second end position as a function of the way in which a variable hydraulic fluid volume is chambered. A volume flow rate of hydraulic fluid leaving the chamber is adjusted by a flow valve, wherein this flow valve is designed as an electrical switching valve with the ability to assume at least three different switch positions.

SUMMARY OF THE INVENTION

The present invention is based on making available a device which is essentially independent of external forces and which can produce high-frequency, stable movements of a gas exchange valve. This is achieved according to the invention by a gas exchange valve arrangement.

An inventive gas exchange valve arrangement, according to one embodiment of the invention, comprises a valve body configured to move in a straight line in either of two opposite directions. An actuating element for actuating the valve body is also provided. A piston of this actuating element can be moved in either of the two directions of movement such that a movement of the piston in at least one direction causes the valve body to move in the same direction. According to one embodiment of the invention, the piston can be moved by a fluid medium relative to a space, wherein this space comprises a feed opening for the fluid medium, and the gas exchange valve arrangement comprises a throttle device, which at least temporarily or at intervals throttles the movement of the piston in at least one direction of its movement.

A movement of the valve body is preferably caused by a movement of the piston in only one direction of movement. The valve body preferably includes a valve head permanently mounted on the valve body.

The valve head mounted on the valve body is the part of the valve which covers an opening, such as an opening inside a cylinder of an internal combustion engine. A spring plate is mounted on the valve body and is preferably connected to it in a positive manner. A section of this valve body can be a rod-like element. The fluid medium is a liquid medium and preferably a hydraulic oil. Due to the throttling of the movement of the actuating element in at least one direction of movement, the actuating element and the valve body are guided in a very stable manner.

The throttle device is preferably designed such that it throttles or damps the movement of the actuating element in different ways as a function of the element's position in the direction of movement.

In a preferred embodiment, a positive connection is not present between the actuating element and the valve body. Thus the actuating element and the valve body can preferably be separated from each other. This means that the actuating element actuates the valve body in one direction, namely, by pushing it, whereas conversely the valve body actuates the actuating element preferably in the other direction of movement.

In one embodiment, the space comprises a discharge opening, which allows the fluid medium to leave the space. In particular, the hydraulic fluid for actuating the actuating element is thus guided through the space.

In one embodiment, the throttle device comprises at least one throttle element, extending in the direction of movement of the piston, for the fluid medium. The guiding of the fluid medium through this throttle element has the effect of throttling the movement of the activity element. It is advantageous for the throttle device to comprise at least one throttle element which is arranged radially outside the piston. In other embodiments, the throttle element is provided inside the piston. At least one throttle element is designed as a channel, which most preferably extends essentially in a straight line. Preferably several and even more preferably all of the throttle elements are designed as channels.

At least one throttle element preferably comprises an internal cross section which changes in the direction of movement of the actuating element. Thus a stable opening movement of the actuating element or of the actuator and thus of the valve is achieved by a damping volume in the actuator or in the space. This damping volume is emptied via special throttles, the geometry of which varies as a function of the translational movement. The gas exchange valve arrangement preferably comprises two throttle elements or channels, which are outside the piston. In this way, it is possible to ensure that the movement of the piston is especially stable.

The throttle elements or channels preferably comprise cross sections which vary in the direction of movement. At least two channel sections, arranged in series in the direction of movement and completely separated from each other, are preferably provided. These two channel sections preferably have different internal cross sections. One of these channel sections preferably brings about a damping or throttling of the movement of the piston in the first direction, and the other channel section brings about a throttling or damping of the movement of the piston in the second direction. It is advantageous for at least one throttle element or channel to be open in the direction toward the piston.

The gas exchange valve arrangement preferably comprises a pretensioning element, which pretensions the valve body in one direction of its movement. This pretensioning element is preferably responsible for the closing movement of the gas exchange valve and also of the actuating element or of the actuator and for the discharge of the hydraulic medium from the space after the switching elements have been shifted as needed by valve springs or actuators connected to the gas exchange valve.

This movement, is preferably controlled by a damping volume, which is controlled by way of variable throttles. The two throttles, as mentioned above, are preferably designed as slots, which, as a result of their arrangement perpendicular to the direction of movement, are covered to an extent which varies depending on the stroke of the actuator. As a result of the previously mentioned embodiment, according to which a positive connection is not present between the actuating element and the gas exchange valve, two goals are achieved: first, the gas exchange valve is not subject to any interference with respect to its charge-exchange characteristic or its independent movement; and, second, the system can also be applied to conventional valves. At the same time, the system requires no active position control or movement control to ensure its proper operation, even though the valve connection tends to be unstable and even though gas may be exerting a force on the valve, wherein the advantages are achieved by the previously mentioned throttle device.

In another embodiment, the gas exchange valve arrangement comprises a first control valve, which controls the feed of the fluid medium into the space. Thus, preferably a hydraulic medium, provided externally under a positive pressure, is guided via the control valve or switching element into an actuator, which is preferably closed off by another switching element. This actuator or this actuating element thus executes a translational movement, transmitted to a gas exchange valve of the internal combustion engine.

In another embodiment, the gas exchange valve arrangement comprises a second control valve, which controls the discharge of the fluid medium from the space.

According to another embodiment, the throttle device is designed in such a way that its throttling action varies as a function of the position of the piston along its path of movement, at least in certain sections of that movement, especially in such a way that the throttling increases as the piston approaches the end points of its path of movement.

The two control valves are preferably solenoid-operated valves. In another advantageous embodiment, the gas exchange valve arrangement comprises at least one position-detecting device, which detects the position of the valve plate or valve body in the direction of movement.

It should be noted that the previously mentioned position-detecting device is also applicable independently of the previously described embodiments. The position-detecting device preferably comprises at least one beam-emitting device and at least one beam-detecting device. The beam-emitting device and the beam-detecting device are arranged such that the path of the beam between the beam-emitting device and the beam-detecting device is influenced at least temporarily by the spring plate or by the valve body (or by a certain part of these elements). The beam-detecting device comprises at least one and preferably a plurality of photocells.

The path of the beam is preferably blocked at least temporarily by the spring plate or the valve body or a part of these elements. In this embodiment, the movement of the gas exchange valve of the internal combustion engine is detected by optical switching elements. The beam-detecting device preferably comprises a plurality of photosensitive elements arranged in the direction of movement. These photosensitive elements are preferably arranged in linear arrays such that, as a result of the movement of the valve, the spring plate attached to the valve exposes the photosensitive elements, one by one.

The position-detecting device preferably comprises a processor unit, which transmits at least one value which is characteristic of the movement of the valve body. This characteristic value is one or more of a position, a speed, an acceleration, or even a jerking or discontinuous movement of the valve body. A downline evaluation logic circuit is proposed, which interprets the switching signals and transmits the actual distance traveled by the valve at the moment in question. These characteristic values are preferably transmitted to the previously mentioned control valves, and on this basis the movement of the gas exchange valve is controlled.

The previously described embodiment makes it possible to use conventional, low-cost optical-electronic components. When illuminated by special diodes, however, their switching time is so short that they can detect the high-frequency movements of a gas exchange valve. The resolution of this measuring device is determined in particular by the density of the switching elements or detection devices in the cell. The downline evaluation logic circuit also has an effect on the quality of the measurements, because it must interpret the measurement signals to determine, for example, whether they originated from direct illumination or merely from reflections of the light, and because it preferably must also detect whether any of the components in question are wet with oil.

The present invention is also directed at an internal combustion engine with a gas exchange valve arrangement of the type described above. The present invention is also directed at a motor vehicle, especially a motor vehicle for highway driving, with an internal combustion engine of the type described above.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

FIG. 1 is a cross-sectional diagram of an inventive gas exchange valve arrangement;

FIG. 2*a* is a top view of the arrangement of FIG. 1 along line A of FIG. 1;

FIG. 2*b* is a top view of the arrangement of FIG. 1 along line B of FIG. 1;

DETAILED DESCRIPTION OF THE PRESENTLY PREFERRED EMBODIMENTS

Figure 3:
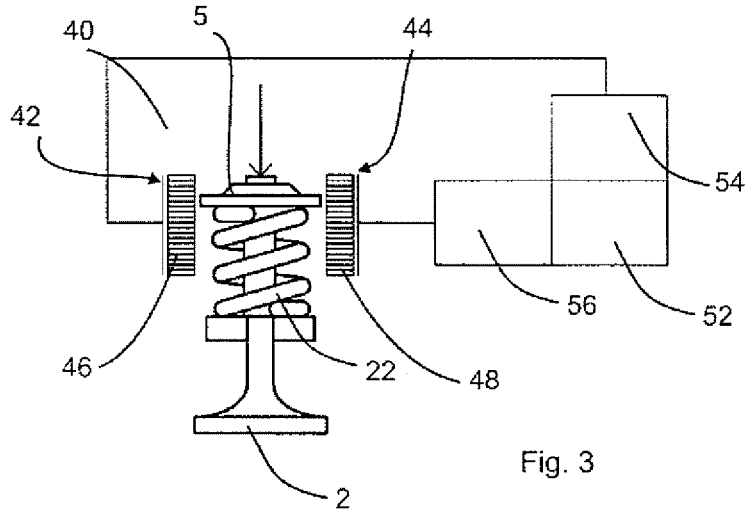
FIG. 3 is a schematic diagram of an optical detection device for the arrangement of FIG. 1.

FIG. 1 is a cross-sectional diagram of an inventive gas exchange valve 1. A valve body 4, on which a valve head 2 is mounted, serves to open and to close a cylinder (not shown). This valve body 4 can be moved in either of the two opposite directions B1 and B2, as indicated by the double arrow. The stroke for this movement is in a range typically between 10 mm and 15 mm and is preferably 12 mm. A valve spring retainer or a spring plate 5, is preferably permanently connected to the valve body 4 that is pretensioned by a spring device 22, in direction B1. This spring device 22 is supported against a wall 27, which is stationary with respect to the movable valve body 4.

An actuating element 12, actuates the valve body 4.

The actuating element 12 also referred to as an actuator, preferably comprises four functional elements, namely, a housing 6; a piston 14; a first control valve 32, preferably a high-pressure valve, that is closed when in the base position shown in FIG. 1; and a second control valve 34 preferably a low-pressure valve that is open when in this base position.

The housing is preferably designed as a two-part assembly, wherein a block (not shown) holds an insert, which forms the housing 6. The piston 14 is guided along the inside walls of the housing 6.

For the purpose of actuating the valve body 4, hydraulic fluid is supplied to the actuating element 12 from a reservoir 7, controlled by the first control valve 32. After leaving this first control valve 32, the hydraulic fluid arrives in a space 16 via feed line 18.

Inside the space 16, the above-mentioned functional elements housing 6, piston 14, first control valve 32, and second control valve 34 form volumes V1, V2, and V3 and throttle elements 11, 19, 25, which will be explained in more detail below The throttle elements 11, 19, and 25 are designated overall as throttle device 30 and are located at the sides of the piston 14.

Volume V1 is formed above the piston 14 as soon as the piston leaves its upper end position. In FIG. 1, volume V1 is therefore zero. Volume V2 surrounds the skirt of the piston in a ring-like manner. When the piston is the upper position, as shown in the diagram, volumes V1 and V2 are connected to each other only by the throttle element 11.

FIG. 2*a* is a top view along line A of the inventive arrangement. We can see here in particular the two throttle elements 11, which are slots located at the sides of the piston 14 and into which hydraulic fluid can flow. These two throttle elements 11, which are open on the side facing the piston, therefore form the channel sections. These two throttle elements 11 serve to damp the movement of the piston 14 in direction B1 during the closing of the gas exchange valve. As will be explained in greater detail below, however, this throttling action does not begin until just before the actual closing of the gas exchange valve, i.e., just before the piston (not shown) reaches its top dead center position.

Throttle elements 11 are introduced in the form of two opposing slots into the guide wall, along which the piston 14 travels. As a result, the effective cross section of the throttle elements 11, i.e., slots, depends on the position of the piston 14.

Volume V3, also designed as a ring-shaped space, is formed underneath the piston 14, between a piston rod or actuating rod 15 on the inside and the piston guide wall on the outside. Volume V2 is connected to volume V3 by the throttle elements 19 and 25, which are connected to each other in series and which are designed as an opposing pair, like the throttle elements 11.

Due to the entrance of hydraulic fluid into the space V1, the piston 14, to which the previously mentioned actuating rod 15 is attached, is pushed down (direction B2) from the position shown in FIG. 1.

During the downward movement in the B2 direction of the piston 14, volume V3 becomes smaller and V1, as previously mentioned, becomes larger. V2 always retains a same volume. The throttle elements 25, in the form of circular bores parallel to the axis of the piston, are arranged in the housing 6 or in the previously mentioned insert and extend down as far as the lower stop plane of the piston guide.

The piston guide wall is interrupted by throttle elements 19 in the lower guide area formed as slots as connecting the throttle bores 25 to volume V3. These throttle elements 19 form a direct connection to volume V3, but they are connected to V2 only by way of the throttle elements 25, a series connection of the throttle elements 25 and 19. As in the case of the throttle elements 11, the effective connecting cross section of the throttle elements 19, which is exposed for the transition to 25, depends on the position of the piston 14 and becomes continuously smaller as the downward movement proceeds.

The high-pressure valve, first control valve 32, is connected on the upstream side by lines to the reservoir 7, oil pressure source P, which is under system pressure. On the downstream side, first control valve 32 is connected to volume V1. Because the high-pressure valve, first control valve 32, is closed in its base state, the system pressure does not act in volume V1 under these conditions. In addition, there is no flow of oil from the oil pressure source P via the control valve 32 into volume V1.

The low-pressure valve, second control valve 34, is connected on its upstream side to volume V2, on the downstream side via lines to a (pressureless) tank 35 of the system. Because the low-pressure valve, second control valve 34 is open in its base state, volumes V1, V2, and V3 of the actuator are without pressure. Further, there is no flow of oil under these conditions. Nevertheless, all of the volumes are preferably filled with oil, and the system is completely vented.

In the following, the function of the inventive gas exchange valve is described in detail.

Applying a voltage to the low-pressure valve, second control valve 34, shifts the valve from its base position, (open) shown in the diagram, into the switched position (closed). Thus the connection of volume V2 and thus of volumes V1 and V2 to the system tank 35 is blocked; nothing flows.

A voltage is then applied to the high-pressure valve, first control valve 32, as a result of which the valve is shifted from its base position (closed), as shown in FIG. 1, into its switched position (open). Volume V1 is thus connected to the oil pressure source P (reservoir 7).

The pressure of the oil pressure source P now acts in volumes V1, V2, and V3. Because the surface of the piston facing V1 is larger than that facing V3, a force is present which pushes the piston 14 downward. During this movement, there are various volume streams in the actuator. Oil flows from volume V3 via the throttle element 19 to the throttle element 25 and then into volume V2.

As a result of the selection of the bore diameter of throttle elements 25 and the width of the slots of the throttle element 11, the cross section of the bores of the throttle element 25 is smaller at the beginning of the stroke than the effective cross section of the throttle elements or slots 19. This means that, at the beginning of the stroke, the throttle element 25 determines the throttling of the volume stream from V3 to V2 and that, during the later course of the stroke, the throttle element 19 takes over this function as the slots become increasingly covered by the piston 14.

There is also a volume flow from V2 to V1, which continues via the throttle elements 11 until the upper edge of the piston passes the lower edge of the throttle elements 11. Then the volume stream now flows between V2 and V1 via the previously described lateral surface of the cylinder. The total volume of the actuator, i.e., the sum of V1, V2, and V3, increases during the downward movement by an amount equal to the volume of the piston rod 14 which travels from the actuator and which thus actuates the gas exchange valve and its spring device 22. This increase in volume is compensated by the volume stream coming from the oil pressure source P via the high-pressure valve control valve 32, and entering volume V1.

The throttling of the volume streams at the throttle elements 11, 19, and 25 affects the movement of the piston 14 and thus of the gas exchange valve 1. In principle, the throttle cross section determines the flow rate and thus the change in pressure in any pressurized volume connected to it. In the present case, therefore, it changes the speed at which the piston 14 moves and the force acting on the piston surface in question.

The way in which the individually described volume streams are throttled at the other geometries and components of the actuator (such as at the control valves 32, 34) and the compressibility of the pressure oil have been ignored in this description. For the outward stroke of the piston 14, the absence of a positive connection between the end of the gas exchange valve stem and the actuator 12 (piston rod 15) is highly advantageous. Depending on the engine operating point, a gas force, which varies with that point, will be present at the gas exchange valve, which means that the actuator 12 exerts a sufficient amount of force to overcome it.

If, at another operating point, however, there is no gas force present or if this force is lower than the design force, the actuator may not be allowed to accelerate the movable elements of the valve body 4 so much that the nonpositive connection between the end of the gas exchange valve stem and the actuator 12 is broken, because in that case the movement of the gas exchange valve would be uncontrolled. This is avoided by the interaction between the throttle elements 19 and 25, so that no active regulation of the position and/or force of the actuator is necessary.

Because the throttle elements 11, as described above, act only in the upper area of the piston guide, that is, only at the beginning of the movement of an outward stroke, which is typically characterized by low speed and thus by low flow rates, they are in practice of no importance with respect to the opening movement of the gas exchange valve. The series connection of the throttle elements 19 and 25 has the result that the throttle element 25 acts in a constant manner at the beginning of the outward stroke, and then—as soon as the effective cross section of the throttle element 19 becomes smaller than that of the throttle element 25—the throttle element 19 with its continuously decreasing cross section goes into action (see above).

The basic result achieved is that, because it becomes increasingly more difficult for the fluid to flow from V3 to V2, the outward movement of the piston 14 is braked at the end of its stroke. The diameter of the throttle bores of throttle elements 25 is coordinated with the maximum design gas pressure which can be present at the gas exchange valve at the beginning of the movement. If the gas force actually present is lower than that, what follows first—considered in an infinitesimally small time step—is an increase in the speed of the movement of the piston 14, which would lead to a faster outflow of oil from V3 to V2 and thus to the danger of uncontrolled movement.

Because this downward motion of piston 14 continues to lead to an increase in the pressure in V3, the force acting on the bottom of the piston also increases, and this force acts in opposition to the force being exerted from the top of the piston, which is excessive in this situation. If only the throttle elements 25 were present, the action of this mechanism would be proportional to the excess force (design force minus actual gas force) and constant over the course of the stroke. Simulations have shown that this is not sufficient to bring about a stable movement of the piston 14 and of the gas exchange valve at various gas forces.

As a result of the addition of the throttle elements 19 in series to the throttle elements 25, the behavior of the mechanism assumes a behavior which is proportional to the excess force but which increases in linear fashion with the outward stroke, a behavior which is suitable for controlling the movement. Significant here is the point at which the action of the throttle element 19 exceeds that of the throttle element 25. This point is established by the choice of the diameter of the throttle element 25 and the slot width of the throttle element 19.

In the realized version, the iterative adjustment of the above-described characteristic by variation of the previously mentioned parameters (diameter of the throttle element 25 and slot width of the throttle element 19) it possible to achieve the goal that the opening movements of the gas exchange valve at maximum gas force are only slightly different from those in the absence of gas force and that controlled movement is present at all times.

As a result of this arrangement and combination of the special hydraulic elements, a hydraulic cylinder of the type described above can bring about movements of a gas exchange valve which occur at high frequency but which are stable at the same time without the need for position control and in a manner which is almost completely independent of any external force which may be present.

In summary, therefore, the outward stroke proceeds with the above-described volume streams between the volumes and, depending on the gas force which is present, is braked at a corresponding level; basically, the braking force increases with the stroke. The piston 14 executes this movement until it reaches the lower stop plane and thus has completely opened the gas exchange valve 4 at which position volume V3 is now emptied and V1 is filled to the maximum. At this point in time, the volume streams come to a standstill; the high-pressure valve, control valve 32, remains open, so that the actuator 12 is not hydraulically locked.

By turning off the voltage supply to the high-pressure valve (control valve 32), the valve is brought back into its base position. The connection of volume V1 and thus of volumes V2 and V3 to the oil pressure source P (reservoir 7) is broken, and there is no longer any volume flow.

Next, the voltage supply to the low-pressure valve (control valve 34) is also turned off, and the valve is thus returned to its base position. Volume V2 and thus volumes V1 and V3 are connected to the system tank 35.

During the outward stroke, the gas exchange valve was moved, but the spring 22 of the valve was also tensioned. This generates a force which moves the piston 14 upward, because in this situation there is no pressure and therefore no force acting on the top surface. The previously described volume streams now flow in the opposite direction. The volume stream from volume V2 to volume V3, however, does not in this case flow via the throttle elements 19 and 25 but rather via check valves (not shown in FIG. 1), which are installed in the previously mentioned housing 6 to prevent aeration and cavitation in the oil.

A volume stream also flows from volume V1 to volume V2 and from there via the discharge line 28 and the low-pressure valve, second control valve 34, to the tank 35, so that the volume of the piston rod 15, now traveling into the actuator, is compensated.

For the inward stroke, it is the last phase of the movement which is important. So that the piston 14 and thus the gas exchange valve will move in a controlled manner with low wear and low noise, the piston should not arrive at the stops at too high a speed. As already suggested above, the throttling action of the throttle elements 11 begins in the upper area of the piston guide. As soon as the upper edge of the piston passes the lower throttling edge of the throttle elements 11, the effective throttle cross section of the throttle element 11 decreases continuously during the further course of the upward stroke. The outflow from V1 becomes more difficult, and the piston 14 is braked to an increasing extent, so that it reaches the end stop at reduced speed. The gas exchange valve therefore experiences the same effect.

During the return movement as well, therefore, the piston travels more quickly at first and then, at the end of the movement, more slowly. Excess hydraulic medium is carried away from the actuating element 12 through a discharge line 28 and the switching valve 34, which is now open.

After all of the volume streams have come to standstill, the system is again in the base condition shown in the diagram.

In summary, it can be said that a significant aspect of the invention is to be found in the effectively planned arrangement and combination of special hydraulic elements in a novel manner, so that a hydraulic cylinder or actuator can bring about high-frequency movements which are stable at the same time without the need for position control and in a manner which is almost completely independent of any external force which may be present.

FIG. 3 shows a detection unit 40 for detecting a position of the valve body 4. More precisely, this detection unit 40 comprises a transmitting device 42, more precisely a plurality of beam sources 46 arranged in a row, and a receiving device 44, more precisely a plurality of detectors 48, also arranged in a row. Through the cooperation between these beam sources 46 and the detectors 48, it is possible to detect the exact position of a spring plate 5 (and thus also of the valve body 4). It is also possible to determine mathematical derivations of this position, that is, speeds and accelerations of the valve body 4. In one embodiment, the beam sources 46 are light-emitting diodes.

A measuring amplifier 56, and an evaluation logic circuit 52, evaluate the signals from the detectors 48, which can be photoelectric cells. A control unit 54 drives the individual beam sources 46. The values or signals transmitted by the evaluation logic circuit 52 can be used to drive the control valves 32, 34.

The detectors 48, i.e., photoelectric cells, are arranged in linear fashion in such a way that they are exposed one by one by the spring plate attached to the valve as the valve executes its movement. The evaluation logic circuit 52 interprets the switching signals and gives as its output the distance traveled by the valve at the moment in question.

Figure 4:
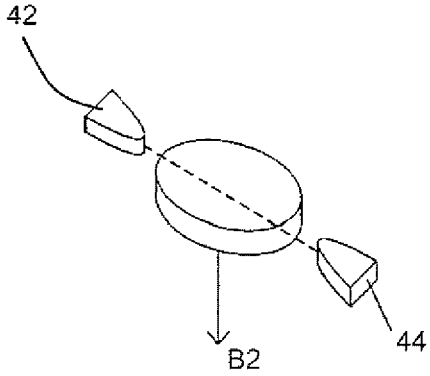
FIG. 4 is another schematic diagram of the optical detection device of FIG. 3.

FIG. 4 is a simplified diagram, in perspective, of an inventive optical detection device 40. Here, too, the miniature light barrier is shown, which consists of the transmitter 42 and the receiver 44. The height of these two elements determines the optical resolution at which the movement is measured.

The individual beam sources 46 preferably emit a beam which is not or only slightly reflected by the spring plate 5, so that these types of reflections exert the least possible influence on the position measurement. It would also be possible to color the spring element 22 and the spring plate 5 black to prevent reflections even more effectively.

A significant aspect of the optical detection described here is to be found in the application of conventional, low-cost optical-electronic components, the switching time of which, when illuminated by special diodes, is so short that they can detect the high-frequency movements of a gas exchange valve. The resolution of the measuring device is determined by the density of the switching elements in the row. The quality of the measurement depends on the downline evaluation logic circuit, because this must interpret the signals to determine whether direct illumination is present or only the reflection of the light and also whether wetting with oil is possibly present.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A gas exchange valve arrangement for an internal combustion engine, comprising:

a valve body configured to move in two opposite directions along a straight line;

an actuating element configured to actuate the valve body, the actuating element comprising:

a space formed in a housing;

a piston having a piston rod and being disposed in the space configured to be moved in the two opposite directions along a path of movement such that, as a result of a movement of the piston in at least one of the two opposite directions causes the valve body to move in the at least one of the two opposite directions, a fluid medium in the space, the piston being moveable in response to the fluid medium; a feed opening configured to present the fluid medium into the space; and a throttle device configured to temporarily throttle the movement of the piston in the two opposite directions, wherein the throttle device comprises a plurality of throttle elements, the plural throttle elements extending in the direction of movement of said piston and having different internal cross sections and being located radially outside and directly adjacent to the piston, and wherein there is no positive connection between the piston rod and the valve body, and a pretensioning element for pretensioning said valve body in its closing position said throttle elements constructed so that the nonpositive connection between the piston rod and the valve body is not broken.

2. The gas exchange valve arrangement according to claim 1, wherein the fluid medium is hydraulic oil.

3. The gas exchange valve arrangement according to claim 1, wherein the space further comprises a discharge opening configured to allow the fluid medium to leave the space.

4. The gas exchange valve arrangement according to claim 3, wherein the discharge opening comprises a second control valve configured to control the discharge of the fluid medium from the space.

5. The gas exchange valve arrangement according to claim 1, wherein each of the throttle elements extends in the direction of the straight line movement of the piston.

6. The gas exchange valve arrangement according to claim 1, wherein each of the throttle elements is in fluid connection to the space.

7. The gas exchange valve arrangement according to claim 1, wherein the feed opening comprises a first control valve configured to control the feed of the fluid medium into the space.

8. The gas exchange valve arrangement according to claim 1, wherein the throttle device is configured so that its throttling action varies as a function of the position of the piston along the path of movement.

9. The gas exchange valve arrangement according to claim 8, wherein the throttling action increases as the piston approaches at least one end position of the path of movement.

10. The gas exchange valve arrangement according to claim 1, wherein the gas exchange valve arrangement further comprises at least one position-detecting device configured to detect at least one position of the valve body in the direction of movement.

11. The gas exchange valve arrangement according to claim 10, wherein the position-detecting device further comprises:

at least one transmitting device configured to transmit a beam;

at least one receiving device configured to receive the beam;

wherein the at least one transmitting device and the least one receiving device are arranged such that a path of the beam traveling between the at least one transmitting device and the at least one receiving device is influenced at least temporarily by at least one of:

a spring plate, the spring plate connected to the valve body;

the valve body; and an attached part connected to the spring plate or the valve body.

12. The gas exchange valve arrangement according to claim 11, wherein the at least one transmitting device comprises a plurality of beam sources arranged in a row along a straight line in the movement direction and the at least one receiving device comprises a plurality of detectors arranged in a row along a straight line in the movement direction.

13. The gas exchange valve arrangement according to claim 10, wherein the position-detecting device further comprises a processor unit configured to generates an output representing at least one value characteristic of a movement of the valve body.

14. An internal combustion engine comprising at least one gas exchange valve arrangement according to claim 1.

* * * * *